United States Patent [19]

DePenti

[11] 3,971,479

[45] July 27, 1976

[54] RAILWAY CAR COUPLER

[75] Inventor: Kenneth L. DePenti, Mayfield Heights, Ohio

[73] Assignee: Midland-Ross Corporation, Cleveland, Ohio

[22] Filed: Jan. 27, 1975

[21] Appl. No.: 544,224

[52] U.S. Cl. ..... 213/127; 213/146

[51] Int. Cl.[2] ..... B61G 3/06

[58] Field of Search ..... 213/146, 148, 144, 127

[56] References Cited

UNITED STATES PATENTS

| | | | |
|---|---|---|---|
| 1,475,634 | 11/1923 | Kelso | 213/127 |
| 2,001,197 | 5/1935 | Kinne | 213/127 |
| 3,856,155 | 12/1974 | Altherr | 213/146 X |

*Primary Examiner*—Drayton E. Hoffman
*Assistant Examiner*—John P. Shannon
*Attorney, Agent, or Firm*—Henry Kozak

[57] ABSTRACT

This invention relates to a railway car coupler of the knuckle type and provides an improvement in the operation of a standard E coupler during a coupling operation. In particular, it concerns the provision of a lock lifter toggle which will assure dropping of the lock to its final locking relation with the coupler knuckle when the knuckle is closed during a coupling operation.

3 Claims, 7 Drawing Figures

FIG.3 PRIOR ART
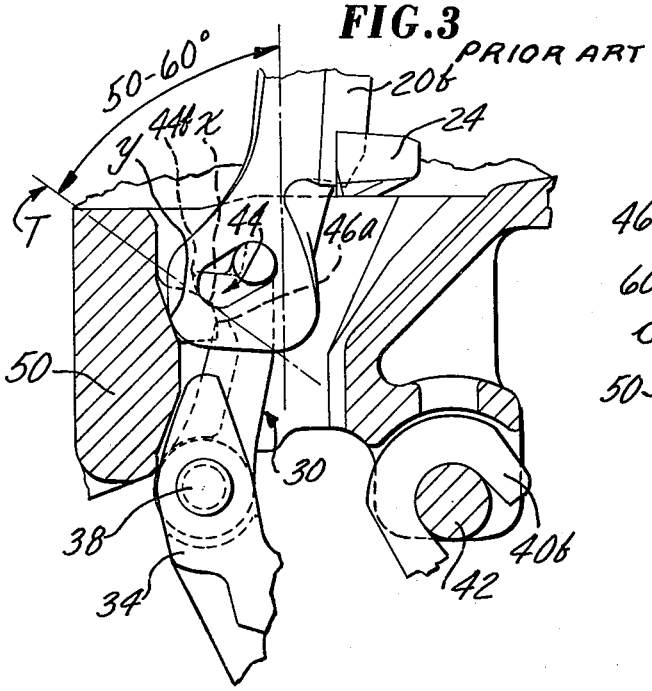
FIG.4
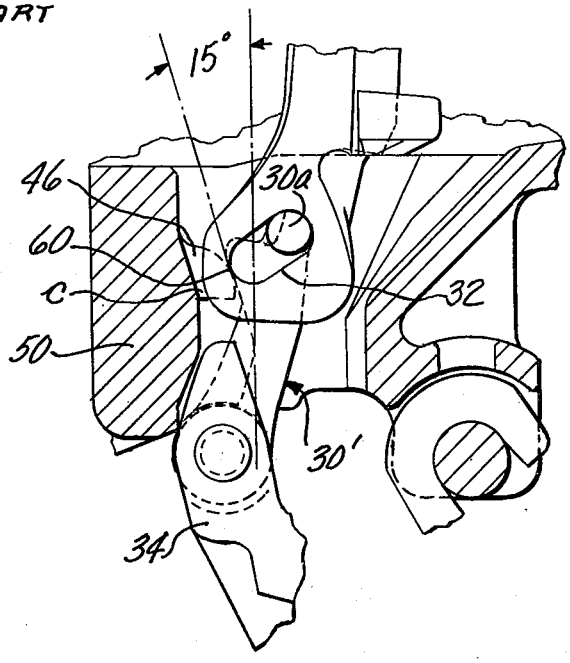
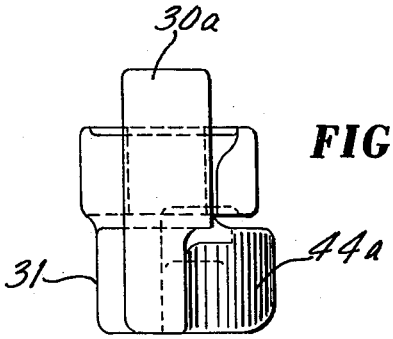
FIG.6
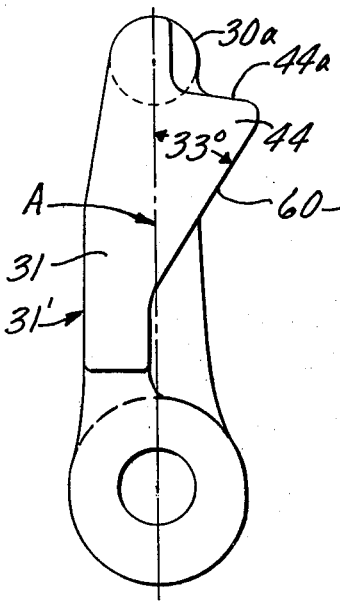
FIG.5
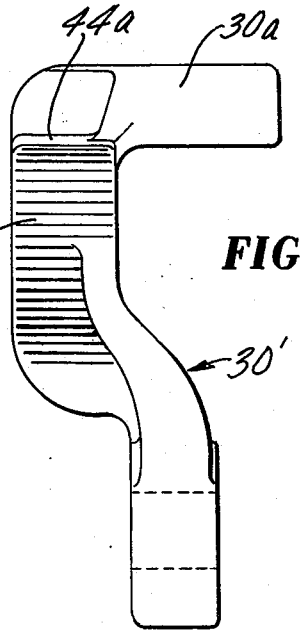
FIG.7

RAILWAY CAR COUPLER

BACKGROUND OF THE INVENTION

While the Association of American Railroads standard E coupler was adopted in 1932, and has provided dependable service over the years, it was recently noted that at times during a coupling operation between cars, the coupler lock would not drop to full locking relation with the knuckle as the latter was closed. In such a case, a hang-up of the lock occurred after it had dropped only a short distance and was held in an elevated position by the engagement between lock lifter toggle and the associated anti-creep lug in the coupler head and between the lock leg and the front wall of the lock receiving chamber in the coupler head. In this position of the lock, the lock anti-creep mechanism is inoperative and the lock is only in partial locking relation with the knuckle. This is a potentially dangerous condition of the coupler in that as coupled railway vehicles travel in service the lock may creep upwards to unlocking relation with the knuckle and result in opening of the knuckle and separation of the vehicles.

Applicant has provided a novel lock lifter toggle which avoids the aforementioned hang-up of the lock during a coupling operation. Moreover, the benefit of this improved toggle is obtained for an existing coupler merely by replacing the existing toggle with the new toggle.

SUMMARY OF THE INVENTION

Specifically the invention comprises a lock lifter toggle which is connected to the lock leg and is formed with an inclined surface adjacent its upper end adapted for engagement with the existing anti-creep lug on the front wall of the lock receiving chamber of the body of an AAR standard E coupler during the dropping of the coupler lock following closing of the knuckle during a coupling operation. The inclined surface commences adjacent the outer edge of the anti-creep shoulder on the toggle and extends downwardly toward the longitudinal axis of the toggle. This inclined surface is adapted to engage the convex top surface of the anti-creep lug during dropping of the lock and is of such inclination as to cause sliding of that surface along the convex surface to assure that the anti-creep shoulder will become completely disengaged from the lug to allow free dropping of the lock to its final knuckle locking position relative to the knuckle. This improved toggle also assures that the forward surface of the lower end of the lock leg will not engage the front wall of the lock chamber as the lock drops to its locking relation with the knuckle, thereby eliminating any frictional drag between the lock leg and that wall such as might interfere with the lock attaining its lowermost locking position.

The various features and advantages of the invention will be set forth in the following description taken in conjunction with the drawings.

BRIEF DESCRIPTION OF THE DRAWING

FIG. 3 is an enlarged fragmentary view in vertical section showing the coupler of FIGS. 1 and 2. The lock is shown in a "hung-up" position which prevents it from dropping to locking position relative to the knuckle.

FIG. 4 is a view similar to FIG. 3 but showing the improved lock lifter toggle and illustrating how the lock is permitted to drop freely to locking position.

FIG. 5 is a side elevation of a lock lifter toggle embodying the invention.

FIG. 6 is a top view of the toggle shown in FIG. 5.

FIG. 7 is a front view of the toggle shown in FIG. 5.

DESCRIPTION OF THE PREFERRED EMBODIMENT

Figure 1:
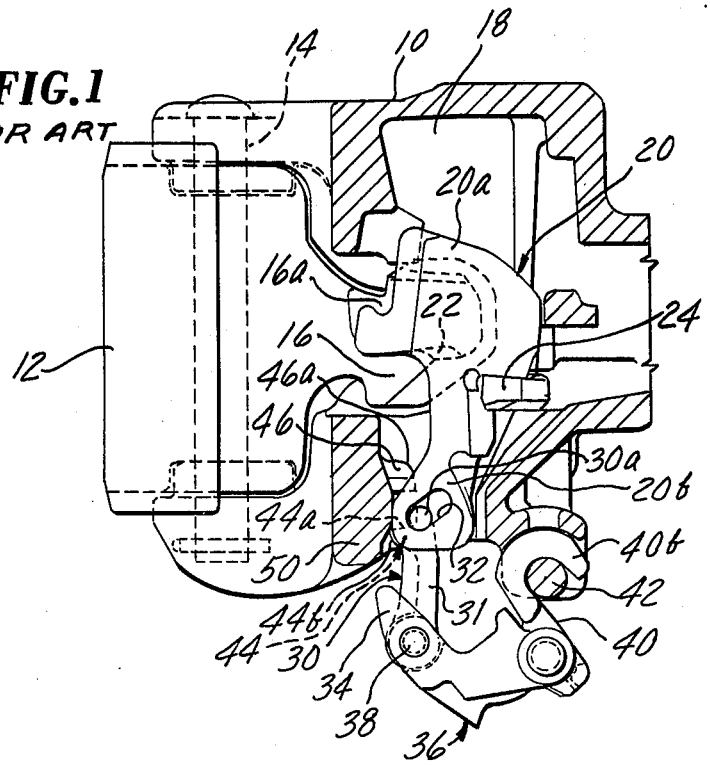
FIG. 1 PRIOR ART
FIG. 1 is a longitudinal vertical sectional view of an existing coupler not embodying the invention showing the parts in locked position.
Figure 2:
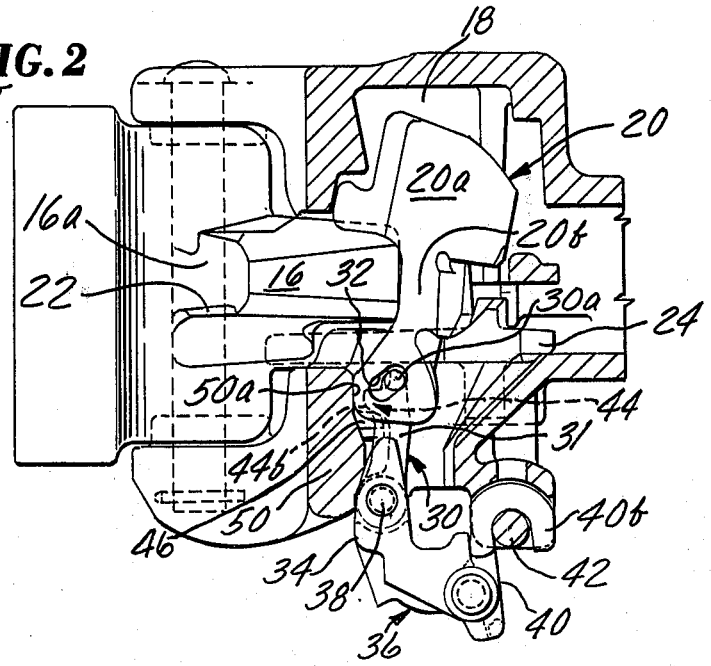
FIG. 2 PRIOR ART
FIG. 2 is a longitudinal vertical sectional view of the coupler shown in FIG. 1 with the coupler parts in position corresponding to full knuckle thrown position, the lock lifter mechanism being shown in reposed position.

Referring to FIGS. 1 and 2 of the drawing there is shown a coupler of the standard E type comprising a head 10 and a knuckle 12 pivotally connected to the head by means of a vertical pivot pin 14. The knuckle has a tail portion 16 which extends into the chamber 18 in head 10 when the knuckle is in closed position as in FIG. 1. The knuckle is maintained in closed position by a lock 20 which is also disposed in chamber 18. Lock 20 comprises a body portion **20*a* which in its locking position is interposed between vertical face 16*a* of tail 16 and a side wall of the coupler head. In its normal locking relation with the knuckle the body portion 20*a* of the lock rests on shelf 22 of the knuckle tail and on knuckle thrower 24 as seen in FIG. 1.**

Lock 20 has a leg portion **20*b* depending from body 20*a* and extending into the lower portion of chamber 18 when the lock is in locking position. Operatively connected to the lower end of leg 20*b* is the conventional lock lifter toggle 30. Toggle 30 has a shank portion 31 at the upper end of which is a laterally extending horizontal trunnion 30*a* which is received in an upwardly and rearwardly sloping slot 32, whereby the toggle is pivotally and slidably connected to the leg. The lower end of toggle 30 is pivotally connected to the forward portion 34 of rotor lever 36 by a rivet 38. The rearward end 40 of the rotor lever has a hook portion 40*b* by means of which the lever is pivotally connected to cylindrical support 42 provided on the underside of the coupler head. It will be understood that the usual uncoupling rod (not shown) is connected to rotor lever 36** for actuation of the same.

Lock lifter toggle 30 is formed with an anti-creep shoulder 44 adjacent trunnion **30*a*, having a flat upper surface 44*a* which is adapted to underlie anti-creep lug 46 on forward wall 50 of chamber 18 when the lock is in locking position. In the event lock 20 should tend to creep upwards or accidentally bounce upwards in service, shoulder surface 44*a* will engage the underside of lug 46** and limit any further upward movement of the lock, thereby preventing possible unlocking of the knuckle and uncoupling from a mating coupler.

Whenever it is desired to unlock the coupler knuckle, the uncoupling rod (not shown) is actuated to effect clockwise rotation of rotor lever 36. The initial actuation of lever 36 causes toggle trunnion **30*a* to slide rearwardly and upwardly to the upper end of slot 32 and thereby moves shoulder 44 rearwardly so as to be out from under anti-creep lug 46. Further actuation of the rotor lever lifts the lock until it is out of locking relation with the knuckle, in which position the lock body 20*a* occupies the upper portion of chamber 18. In the process of moving upwards, the lock leg 20***b* actuates the knuckle thrower 24 which serves to open the knuckle as is well known in the art. At the conclusion of the opening of the knuckle, the coupler parts appear as shown in FIG. 2. Lock 20 rests on and is supported by the top side of the knuckle tail 16, toggle 30 being in reposed position wherein its convex surface 44*b* bears against lug 46. It will be noted that the lower forward face of the lock leg bears against surface 50*a* of wall 50.

During a coupling operation as the knuckle closes, the tail 16 swings into chamber 18 to a position in which it is no longer in supporting relation with lock 20 which, therefore, drops by gravity. Normally, the lock will drop to its full locking relation with the knuckle as shown in FIG. 1. However, in certain instances the lock has been found not to drop to the FIG. 1 position but becomes hung-up after it drops only a short distance, as shown in FIG. 3. In FIG. 3, the convex surface 44*b* of the toggle on the underside of shoulder 44 is engaged with the opposing convex surface 46*a* as at *x*. In addition, the lower forward face of the lock leg also bears against wall 50 as at *y*. The frictional resistance at *x* and *y* under this condition of the parts is sufficient to resist dropping of the lock to full locking position relative to the knuckle. It should be pointed out that the tangent "T" to the point of contact *x* makes an angle with the vertical that lies in the range of about 50° to 60°. Accordingly, the force normal to tangent T producing friction at point *x* is, therefore, substantial. This normal force is so reduced in amount by the improved toggle, as will be hereinafter pointed out, that the frictional force is insignificant, and the lock will, therefore, drop to its full locking relation with the knuckle.

The improved lock lifter toggle 30′ is shown in FIGS. 4 to 7 and precludes the hang-up of the lock illustrated in FIG. 3. Toggle 30′ is similar to toggle 30 but is formed with a flat inclined surface 60 which is disposed beneath shoulder surface 44*a* on the forward side of the toggle as it is positioned in the coupler. Surface 60 is arranged at an angle of about 33° relative to the longitudinal axis "A" of the toggle, commencing adjacent the forward rounded edge of shoulder 44 and extending downwardly and inwardly to about the mid-point of the length of the link. It will be observed that surface 60 is of substantial length, it being equal at least to one-third of the length of the toggle as viewed in FIG. 5. As the lock drops following knuckle closing, surface 60 engages convex surface 46*a* of anti-creep lug 46. As this engagement occurs, surface 60 is disposed at about 15° to the vertical and this tilt of the surface precludes any hang-up of the lock. It will be appreciated that under this condition the normal force acting against lug 46 will be small and the frictional force opposing sliding of surface 60 relative to the lug will be inconsequential. It will be observed in FIG. 4 that trunnion 30*a* is in the upper rearward end of slot 32 in the lock leg. Thus, as the lock and toggle drop, surface 60 cams the lock leg rearwardly so that a clearance exists between the lock leg and forward wall 50, as at *c*, thereby avoiding the frictional engagement as occurs in FIG. 3 with the existing toggle. An important advantage of the improved toggle resides in the fact that its benefits are obtainable in existing couplers by merely replacing the conventional toggle with the improved one.

What is claimed is:

1. A car coupler having a head, a knuckle pivoted to said head and swingable from closed to open position, said head having a lock receiving chamber provided with a front wall, a lock in said chamber, said lock having a lower position in which the lock is in locking relation with the knuckle when the latter is closed, said lock being movable to an upper position in which the lock is out of locking relation with said knuckle, said lock having a depending leg, a lock lifter toggle operatively connected to said leg, a rotor lever pivoted to said head and pivotally connected to said toggle, said lever being operative to effect lifting of said lock out of locking position with said knuckle to permit opening of the knuckle, anti-creep means on said toggle and wall to prevent undesired upward movement of said lock from its locking position, said means comprising a rearwardly extending lug on said wall and a forwardly extending shoulder on the upper end of said toggle adapted to underlie said lug, said shoulder having a flat inclined surface on its underside adapted to engage said lug as said lock drops by gravity from said upper position toward locking position as said knuckle is closed, said inclined surface upon engagement with said lug being adapted to cam said leg rearwardly so as to provide a clearance between said wall and the forward side of said leg during dropping of said lock, said inclined surface commencing adjacent the forward edge of said shoulder and extending downwardly and inwardly to about the midpoint of the length of the link, said surface being disposed at an angle of about 15° to the vertical when said surface engages said lug so as to effect positive downward sliding of said inclined surface against said lug so that said shoulder becomes completely disengaged from said lug to allow free dropping of said lock to its knuckle locking position.

2. A coupler as set forth in claim 1 in which said inclined surface on the toggle is disposed at an angle of about 33° with respect to longitudinal axis of the toggle.

3. A lock lifter toggle for use in a knuckle type coupler of the type having a vertically movable lock, the coupler having a head formed with a lock receiving chamber having a front wall and an anti-creep lug extending rearwardly from said wall, said toggle comprising a shank portion having at its upper end a horizontal trunnion extending laterally therefrom, and an anti-creep shoulder adjacent said trunnion, said shoulder having a top abutment surface and an inclined flat surface commencing from adjacent the forward edge of said abutment surface and extending downwardly and inwardly to about the midpoint of the length of the toggle, said inclined surface being disposed at an angle of about 33° with longitudinal axis of the toggle so as to have positive sliding engagement with said lug in the coupler head during dropping of the associated coupler lock following movement of the knuckle from open to closed position, said inclined surface making an angle of about 15° with the vertical during said sliding engagement of said inclined surface with said lug.

* * * * *